US011560207B2

(12) United States Patent
Gamberini et al.

(10) Patent No.: US 11,560,207 B2
(45) Date of Patent: Jan. 24, 2023

(54) MASK FOR UNDERWATER USE, IN PARTICULAR OF GRANFACIAL TYPE WITH ASSISTED BREATHING

(71) Applicant: MESTEL SAFETY S.R.L., Sant'Olcese (IT)

(72) Inventors: Sergio Gamberini, Genoa (IT); Gabriele Cucchia, Genoa (IT)

(73) Assignee: MESTEL SAFETY S.R.L., Sant'Olcese (IT)

( * ) Notice: Subject to any disclaimer, the term of this patent is extended or adjusted under 35 U.S.C. 154(b) by 85 days.

(21) Appl. No.: 16/910,525

(22) Filed: Jun. 24, 2020

(65) Prior Publication Data

US 2020/0398955 A1 Dec. 24, 2020

(30) Foreign Application Priority Data

Jun. 24, 2019 (IT) ..... 102019000009903

(51) Int. Cl.
*B63C 11/14* (2006.01)
*B63C 11/16* (2006.01)
*B63C 11/12* (2006.01)

(52) U.S. Cl.
CPC ..... *B63C 11/14* (2013.01); *B63C 11/16* (2013.01); *B63C 2011/128* (2013.01); *B63C 2011/165* (2013.01)

(58) Field of Classification Search
CPC ..... B63C 11/02; B63C 11/12; B63C 11/14; B63C 11/16; B63C 11/18; B63C 11/20;
(Continued)

(56) References Cited

U.S. PATENT DOCUMENTS 5,297,545 A * 3/1994 Infante ..... B63C 11/202 128/204.26
6,478,024 B1 * 11/2002 White, Jr. ..... B63C 11/207 128/201.27

(Continued)

FOREIGN PATENT DOCUMENTS

CN 109572963 A 4/2019
WO 2019019549 A1 1/2019

OTHER PUBLICATIONS

IT Search Report dated Feb. 11, 2020, Application No. IT 2019000009903, pp. 1-7, citing: US 2005/0000515 A1, WO 2019/019549 A1 and CN 109 572 693 A.

*Primary Examiner* — Colin W Stuart
(74) *Attorney, Agent, or Firm* — Cantor Colburn LLP

(57) ABSTRACT

A diving mask includes a transparent visor, a frame, a gasket to guarantee the watertight seal and appropriate belts for fitting the mask, a breathing tube associated with the facial part is fitted onto the upper part of the mask and which enables the flow of air to enter into the compartment between the frame and the visor. The path of air in the inhalation phase and in the exhalation phase both in the mask and tube are different from each other. The tube is made with separate ducts for inhalation and exhalation and the inside of the mask is made with two compartments, one upper front and one lower oronasal separated by a wall. The path provides that inhalation air is introduced by the tube into the frontal compartment and then into the oronasal one and air exhaled from the oronasal compartment travels up to the tube.

7 Claims, 6 Drawing Sheets

(58) Field of Classification Search
CPC ..... B63C 11/202; B63C 11/205; B63C 11/22; B63C 2011/128; B63C 2011/165
See application file for complete search history.

(56) References Cited

U.S. PATENT DOCUMENTS

| | | | | |
|---|---|---|---|---|
| 2005/0000515 | A1 | 1/2005 | Pokras | |
| 2007/0174952 | A1* | 8/2007 | Jacob | B63C 11/16 2/426 |
| 2018/0362129 | A1* | 12/2018 | Colborn | B63C 11/2227 |
| 2019/0225312 | A1* | 7/2019 | Barone | B63C 11/16 |
| 2020/0102059 | A1* | 4/2020 | Wung | B63C 11/16 |
| 2020/0189700 | A1* | 6/2020 | Vaccaro | B63C 11/16 |
| 2020/0231260 | A1* | 7/2020 | Liao | B63C 11/16 |

* cited by examiner

MASK FOR UNDERWATER USE, IN PARTICULAR OF GRANFACIAL TYPE WITH ASSISTED BREATHING

CROSS REFERENCE TO RELATED APPLICATIONS

This application is related to and claims the benefit of Italian Patent Application No. 102019000009903, filed on Jun. 24, 2019, the contents of which are herein incorporated by reference in their entirety.

TECHNICAL FIELD

The present disclosure relates to a mask for diving, in particular of the full face type provided with a mouthpiece for being able to breathe with the head under the water surface, provided with a device for assisted breathing.

BACKGROUND

Masks for diving, also known as diving masks, comprise a part or frame made of rubber or silicone which adheres to the face of a user him/herself and at least one belt that is wrapped around the head of the user and at least a transparent part, generally made of glass or plexiglass, adapted to enable underwater viewing and cancel the phenomenon of refraction that determines blurred vision under water. The glass and the rubber frame at least partially isolate in a watertight way from the underwater environment allowing correct vision.

In diving activity, in recent years a second type of mask has been introduced called a full face mask, which covers the entire face, including the mouth. Such second type of mask comprises a transparent visor, a frame a rubber gasket adapted to guarantee the watertight seal and appropriate belts for fitting the mask onto the face. A breathing mouthpiece is associated with such facial part of the mask which is fitted onto the upper part of the frame and which enables the flow of air to enter into the compartment created between the frame and the visor.

The air path when breathing in and that when breathing out are advantageously different from one another.

In fact, for that purpose, two compartments are obtained within the mask, a main upper one in the area of the eyes and cheekbones of the user and an oronasal one which is associated with the nose and mouth of the user. Such compartments are separated by a separation wall provided with valves for air.

The inhaled air reaches the main compartment of the mask through the tube, laps the transparent part or visor, crosses the wall by means of the mentioned valves and reaches the oronasal compartment to be breathed.

The air exhaled by the mouth or nose does not exit from the oronasal compartment, as the valves on the separation wall prevent it from doing so, but it reaches the tube through a perimeter exhalation duct of the mask.

The tube itself is made with separate ducts for the inhaled and exhaled air provided with appropriate directional valves.

This prevents the known inconvenience of the fogging of the mask, as only the fresh air coming from the outside laps the transparent wall whereas the exhausted air exits from the mask without passing into the facial area thereof.

A mask of this type is described in patent application EP3153400 in the name of the same applicant.

The applicant has observed that in a mask of the full face type, the inhalation operation can sometimes become difficult and the user could have the sensation of not breathing in as much fresh air as he/she would like.

SUMMARY

With the present disclosure the applicant proposes a full face mask in which the inhalation step is improved through a device for assisted breathing which reduces the inhalation effort.

This and other advantages according to the present disclosure are obtained by making a full face diving mask as recited in claim 1.

Further characteristics of the diving mask are subject matter of the dependent claims.

BRIEF DESCRIPTION OF THE DRAWINGS

The features and advantages of a diving mask according to the present disclosure will be more apparent from the following description, which is to be understood as exemplifying and not limiting, with reference to the schematic attached drawings, wherein.

DETAILED DESCRIPTION OF THE DRAWINGS

Figure 1:
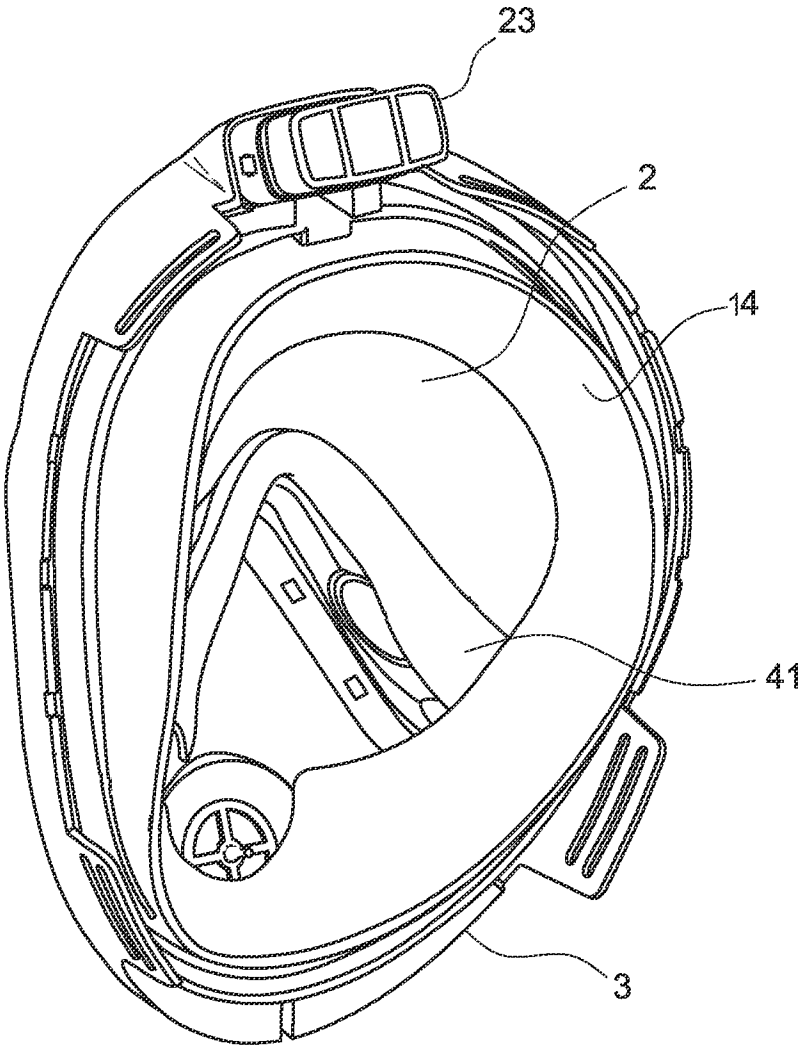
FIG. 1 is a perspective view of the mask according to the present disclosure without the tube and the closing belts.
Figure 2:
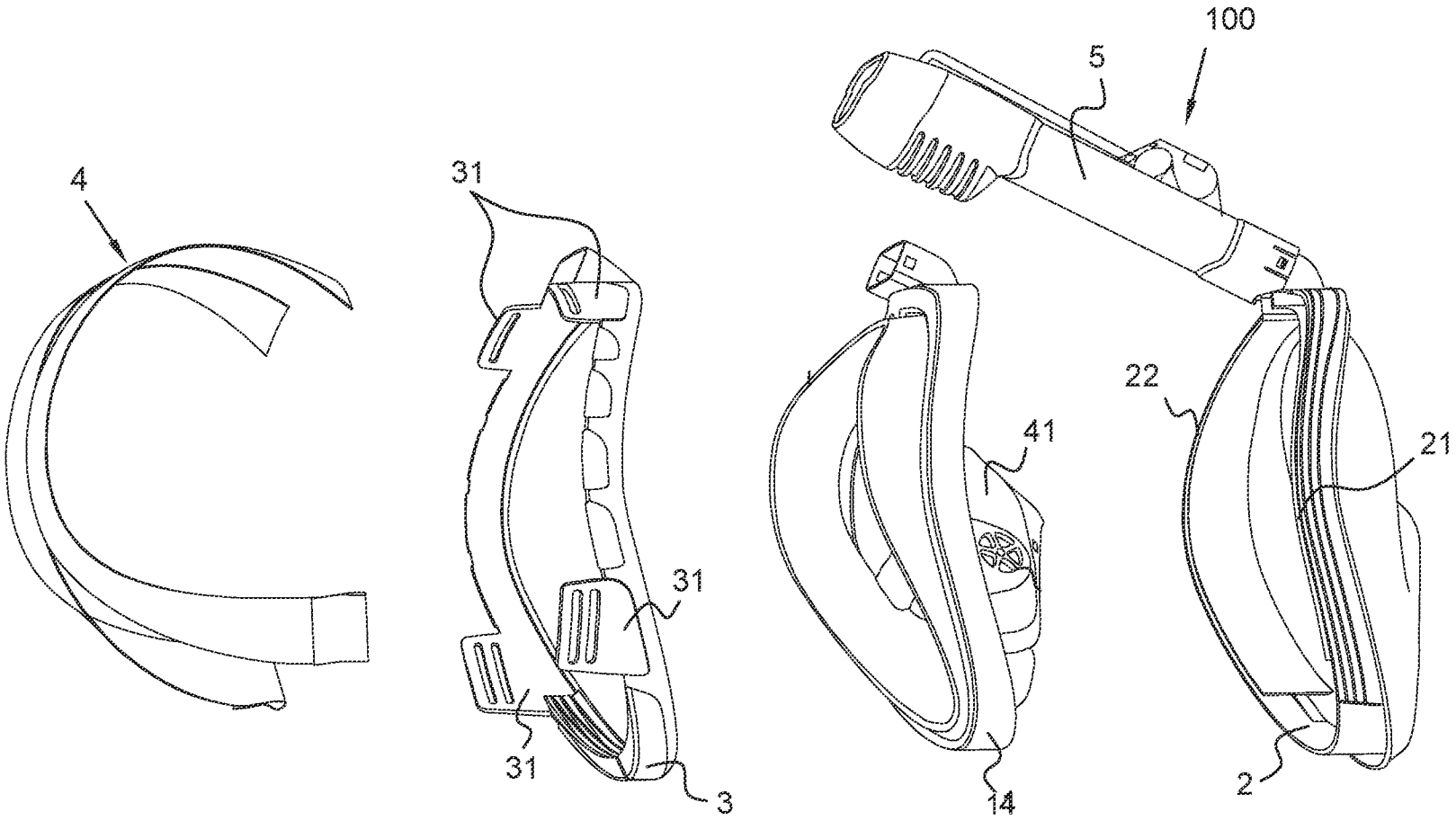
FIG. 2 is an exploded perspective view of the mask according to the present disclosure.
Figure 3:
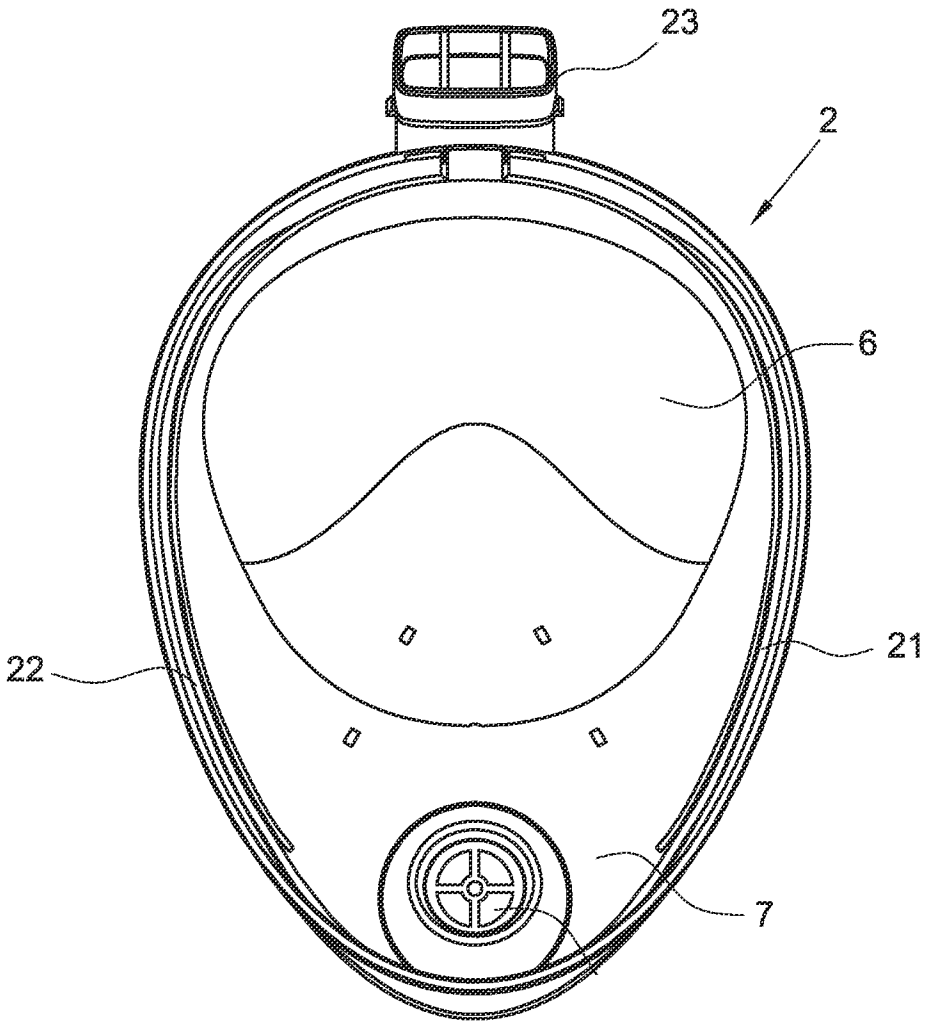
FIG. 3 illustrates a perspective view of the visor of such mask.
Figure 4:
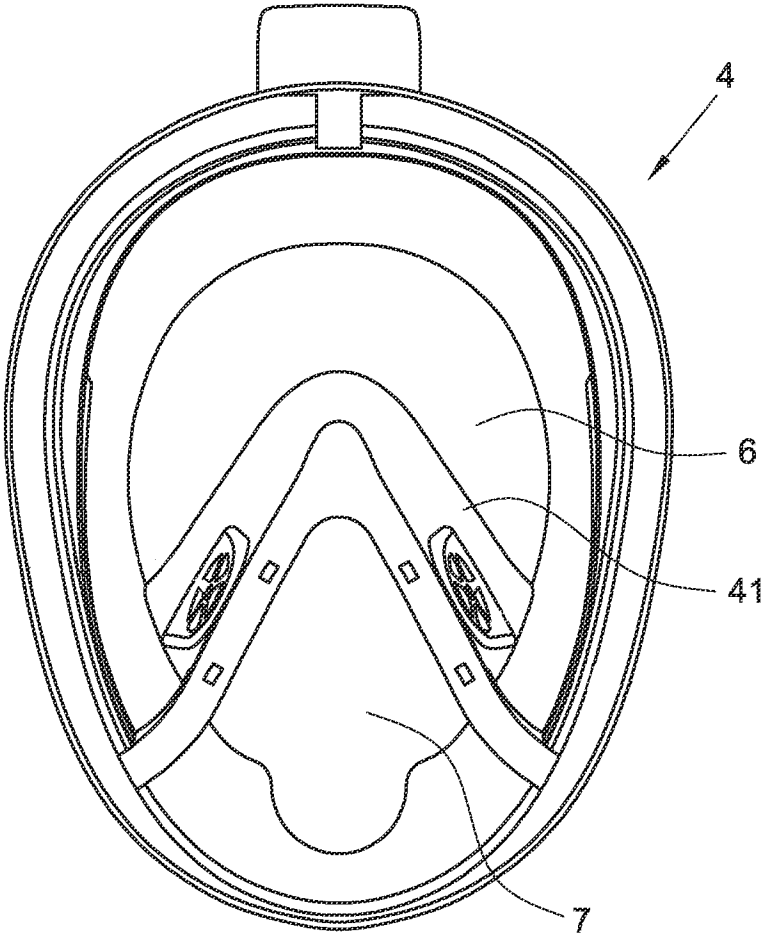
FIG. 4 illustrates a perspective view of the gasket of such mask.
Figure 5:
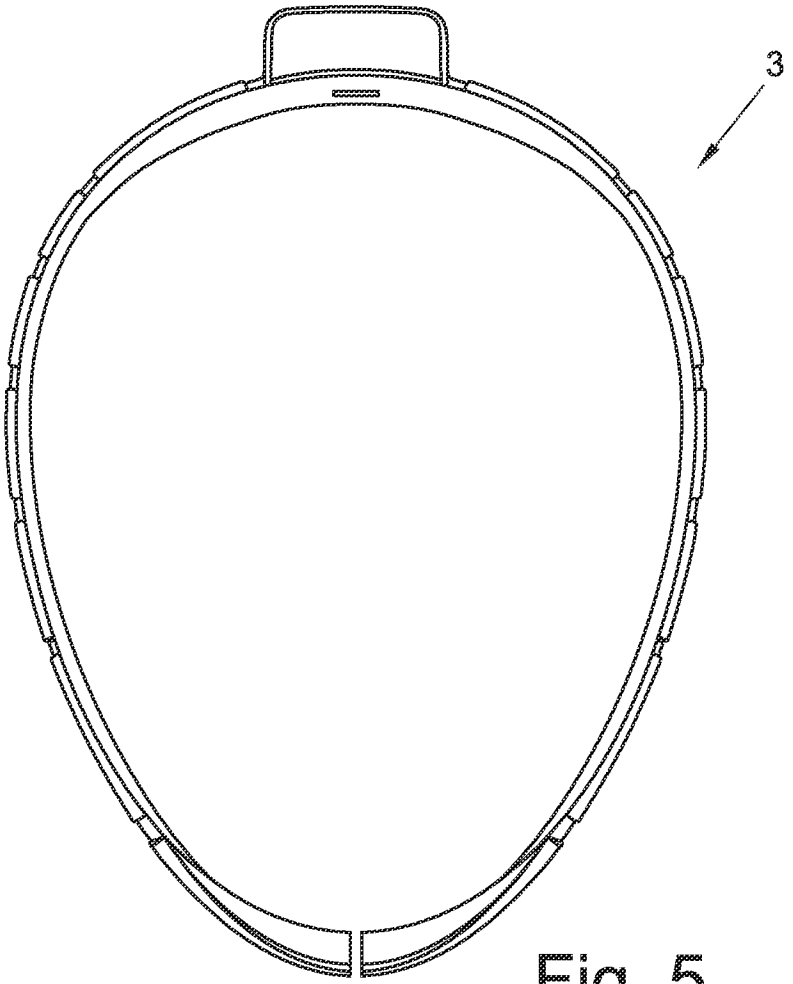
FIG. 5 illustrates a perspective view of the frame of such mask.
Figure 6:
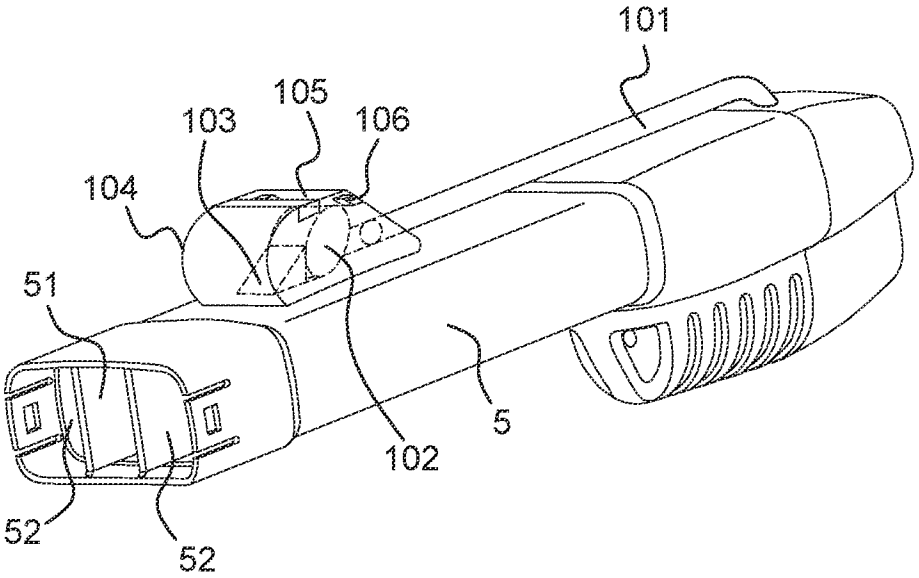
FIG. 6 illustrates a perspective view of the tube of such mask.

With reference to the mentioned figures, a diving mask is shown of the so-called full face mask which comprises a transparent visor 2, a frame or strap 3, a gasket 14 preferably made of rubber adapted to guarantee the watertight seal and appropriate belts 4 to fit the mask onto the face.

A breathing tube 5 is associated with such facial part of the mask which is fitted onto the upper part of the mask and which enables the flow of air to enter into the compartment created between the frame and the visor.

The air path during the inhalation step and that in the exhalation step both in the mask and in the tube are advantageously different from one another.

The tube is for that purpose made with separate ducts for the inhalation and exhalation air.

Preferably, the inhalation duct is placed in a central position and there are two exhalation ducts 52 placed to the sides of the central inhalation one.

Substantially on the top of such ducts one-directional valves (not illustrated) are located which enable the passage of air only in the desired direction.

In fact, still for the purpose of creating differentiated paths within the mask, two compartments are obtained, a main one 6, in the area of the eyes and cheekbones of the user and an oronasal one 7 which is associated with the mouth of the user.

Such compartments are separated by a separation wall 41, made in association with the gasket and provided with at least one housing for at least one one-way valve for the passage of air from the main compartment to the oronasal one. Advantageously, there are two valves placed laterally in a symmetrical position with respect to a vertical centreline plane that crosses the mask.

On said centreline plane in a lower portion of the oronasal compartment a valve is obtained for the exit of liquid from the aforesaid compartment if water has inadvertently penetrated into the mask.

The inhaled air reaches the main compartment of the mask through the tube, laps the transparent part or visor, crosses the wall by means of the mentioned valves and reaches the oronasal compartment to be breathed.

The air exhaled by the mouth or nose does not exit from the oronasal compartment, as the valves on the separation wall prevent it from doing so, but it reaches the tube according to the present disclosure through a perimeter exhalation duct of the mask.

Such path comprises a pair of perimeter channels 21 and 22 obtained in the edge of the visor preferably with a substantially U-shaped conformation which when the visor is associated with the gasket are closed by a flat annular edge of the gasket, forming the same number of perimeter ducts for the exhalation air. Such channels extend from the top of the visor where there is a coupling means of the mask to the tube made in the form of a housing 23 for the engagement of such tube, to beyond the position in which the separation wall 41 between the two compartments is joined to the visor itself. This is to prevent the exhalation ducts from communicating with the first compartment.

The coupling means of the mask to the tube also determine the coupling of the respective exhalation ducts of the tube and of the mask. While the inhalation duct of the tube leads directly into the upper main compartment 6.

The channel created in the visor and enclosed by the gasket is a substantially undeformable channel, as the visor is made of substantially rigid or semi-rigid material; this guarantees the excellent outflow of the air exhaled in any condition and regardless of the size of the user's face.

Furthermore, both the channel and the engagement for the tube are made in the visor; this determines the constructive facility of the strap which becomes a simple ring provided only with hooks 31 for the belts 4 which maintains the assembly of the mask. The only complex element to be created in the mask remains the visor, which can however be conventionally printed preventing the gas insufflation procedure which in masks of the known type was used for creating the channel in the gasket.

According to the present disclosure, such mask and full face masks in general can be associated with an assisted inhalation device 100 which comprises a suction channel 101 which takes the suction air in proximity to the top of the suction duct 51 of such tube 5, motorized ventilation means 102 which enable the forced suction of the suction air from such tube, a conveyor 103 which re-injects the forcibly sucked air into the suction duct 51 of the tube 5.

Preferably, such channel 101 takes the air upstream of the one-way valve which enables the air to enter into the suction duct 51.

Preferably, such conveyor injects the forcibly sucked air into the suction duct 51 downstream of such one-way valve.

The device is advantageously positioned along the tube, in a relevant container 104 preferably in a proximal position to the lower end of the tube that is engaged in the visor 2.

The device 100 further comprises a battery, preferably rechargeable, arranged in a relevant housing 105 of the device that supplies the ventilation means 102.

The device is further provided with at least one immersion sensor 106 preferably placed on the container which detects if the device is on the surface or immersed with respect to the water level. An electronic control unit placed in the container controls the ventilation means based on the measurements of such sensor.

The device can be advantageously hooked onto the tube, for example by means of an open sleeve snapping onto such tube.

The invention claimed is:

1. A diving mask comprising: a transparent visor, a frame, a gasket made of a rubber configured for providing a watertight seal and a plurality of belts configured for putting the mask on a face, a facial part of the mask being connected to a breathing tube inserted on an upper part of the mask and allows a flow of air to enter a compartment formed between the frame and the visor, a first path of the air in an inhalation phase and a second path of the air in an exhalation phase both in the mask and in the tube being different from each other, the tube being made with separate ducts for inhalation air and exhalation air and the inside of the mask being made with two spaces one upper front and one lower oronasal separated by a separation wall, the first path inside the mask provides that the inhalation air is introduced by the tube into a frontal compartment and then in an oronasal compartment and the air exhaled from the oronasal compartment travels up to the tube, wherein an assisted inhalation device comprises a suction channel which draws suction air near the top of a suction duct of the tube, a ventilation component motorized which allows forced suction of intake air from said channel, a conveyor which re-injects the forcibly sucked air into the suction duct of the tube.

2. The mask according to claim 1, wherein said channel draws the air upstream of a one-way valve which allows air to enter the suction duct and said conveyor re-injects the forcibly sucked air into the suction duct downstream of said one-way valve.

3. The mask according to claim 1, wherein the device is positioned along the tube, in a container in a position close to the lower end of the tube that is inserted in the visor.

4. The mask according to claim 3, wherein the device is provided with at least one immersion sensor placed on the container which detects if the device is in emersion or immersion with respect to a water level.

5. The mask according to claim 4, wherein an electronic control unit placed in the container controls the ventilation component based on the measurements of said at least one immersion sensor.

6. The mask according to claim 1, wherein the device further comprises a battery arranged in a housing of the device that supplies the ventilation component.

7. The mask according to claim 1, wherein the device is configured to be hooked onto the tube, by means of an open sleeve snapping onto the tube.

* * * * *